US010006419B1

(12) United States Patent
Hoffman et al.

(10) Patent No.: US 10,006,419 B1
(45) Date of Patent: Jun. 26, 2018

(54) INTEGRATED INTAKE PLENUM AND CRANKCASE COVER FOR AN OUTBOARD MARINE ENGINE

(71) Applicant: Brunswick Corporation, Lake Forest, IL (US)

(72) Inventors: Daniel P. Hoffman, Waupun, WI (US); Jeffrey A. Vandenabeele, Appleton, WI (US); George D. Idzikowski, Lomira, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days. days.

(21) Appl. No.: 15/295,358

(22) Filed: Oct. 17, 2016

(51) Int. Cl.

| | |
|---|---|
| ***F02M 35/10*** | (2006.01) |
| ***B63H 20/32*** | (2006.01) |
| ***F02M 35/16*** | (2006.01) |
| ***B63H 20/00*** | (2006.01) |
| ***F02B 61/04*** | (2006.01) |

(52) U.S. Cl.
CPC ..... *F02M 35/167* (2013.01); *B63H 20/001* (2013.01); *B63H 20/32* (2013.01); *F02B 61/045* (2013.01); *F02M 35/1036* (2013.01); *F02M 35/10347* (2013.01)

(58) Field of Classification Search
CPC ..... F02M 35/167; F02M 35/1036; F02M 35/10347; B63H 20/32; B63H 20/001; F02B 61/045
USPC ..... 440/88 A, 88 C
See application file for complete search history.

(56) References Cited

U.S. PATENT DOCUMENTS

| | | | | | |
|---|---|---|---|---|---|
| 4,346,676 | A | | 8/1982 | Tyner | |
| 5,083,538 | A | | 1/1992 | Hubbell | |
| 5,273,016 | A | * | 12/1993 | Gillespie | F02B 61/045 123/403 |
| 5,344,350 | A | | 9/1994 | Hatch | |
| 5,941,205 | A | * | 8/1999 | Hiraoka | F02B 61/045 123/184.35 |
| RE36,451 | E | * | 12/1999 | Gillespie | F02B 61/045 123/403 |
| 6,302,754 | B1 | * | 10/2001 | Kashima | F01N 13/004 440/88 R |
| 7,198,019 | B1 | | 4/2007 | Belter | |
| 7,296,552 | B2 | * | 11/2007 | Katayama | F02M 35/10032 123/184.34 |
| 8,133,086 | B2 | | 3/2012 | Yoshida | |

OTHER PUBLICATIONS

Unpublished U.S. Appl. No. 14/195,115, filed Mar. 3, 2014.

* cited by examiner

*Primary Examiner* — Anthony D Wiest
(74) *Attorney, Agent, or Firm* — Andrus Intellectual Property Law, LLP

(57) ABSTRACT

An outboard marine engine comprises a crankcase; a crankshaft disposed in the crankcase and being rotatable about a crankshaft axis; a crankcase cover on the crankcase, the crankcase cover enclosing the crankshaft in the crankcase; and an air intake plenum that is integrally formed with the crankcase cover. The air intake plenum conveys intake air for combustion in the outboard marine engine.

16 Claims, 5 Drawing Sheets

INTEGRATED INTAKE PLENUM AND CRANKCASE COVER FOR AN OUTBOARD MARINE ENGINE

FIELD

The present disclosure relates to outboard marine engines and more particularly to intake plenums and crankcase covers for outboard marine engines.

BACKGROUND

The following U.S. Patent Application and U.S. Patents are incorporated herein by reference in entirety:

U.S. patent application Ser. No. 14/195,115 discloses an outboard marine engine having an engine block; a crankcase on the engine block; a crankshaft disposed in the crankcase for rotation about a crankshaft axis; a cover on the crankcase; a bedplate disposed between the engine block and the cover, the bedplate having a plurality of bearings for supporting rotation of the crankshaft; and a cooling water jacket that extends parallel to the crankshaft axis along a radially outer portion of the plurality of bearings. The cooling water jacket carries cooling water for cooling the plurality of bearings and at least one oil drain-back area is located adjacent to the cooling water jacket. The at least one oil drain-back area drains oil from the crankcase.

U.S. Pat. No. 7,198,019 discloses a lubricating system for a marine engine providing a lubrication deflector, which extends from the cylinder block of the engine toward rotating surfaces of a crankshaft and/or connecting rod. A lubrication passage is provided as an integral part of a cylinder block of the marine engine to direct a flow of liquid lubricant away from the lubrication deflectors and downwardly toward a lubrication reservoir, or sump.

U.S. Pat. No. 5,344,350 discloses an outboard marine drive having a powerhead including an internal combustion engine, an adaptor plate mounted to the engine, and a lower gearcase including a torpedo housing rotatably mounting a propeller. The lower gearcase is directly mounted to the adaptor plate without a driveshaft housing there between. An enclosing cowl has left and right sidewalls, a back wall, and a top wall, and is open to the bottom and open to the front facing the boat. The adaptor plate is mounted to the bottom of the engine and closes the open bottom of the cowl in a horizontal plane. The engine has left and right sides closing the open front of the cowl in a vertical plane. The engine has a pair of upper and lower vertically spaced mounting arms integrally cast with the engine crankcase and extending forwardly toward the boat and journaled respectively to upper and lower ends of a king pin of a swivel bracket.

U.S. Pat. No. 5,083,538 discloses an air intake system for an internal combustion engine associated with the power head of an outboard marine propulsion system. The engine includes a vertical crank shaft and a flywheel mounted to the crank shaft above the engine block. An air manifold is mounted to the forward side of the engine, and includes an air inlet for receiving intake air. The air intake system includes an air flow path or duct defined by a series of walls, a rearwardly facing air intake opening and a discharge opening for supplying intake air to the air manifold inlet. The engine is enclosed within a cowl assembly, and the air intake opening is located toward the upper end of the cowl assembly interior. The walls defining the air flow duct are formed integrally with a flywheel cover for facilitating assembly of the air flow duct to the engine. The air flow duct minimizes ingestion of water into the engine and reduces engine noise in the boat.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter. In some examples, an outboard marine engine comprises a crankcase; a crankshaft disposed in the crankcase and being rotatable about a crankshaft axis; a crankcase cover on the crankcase, the crankcase cover enclosing the crankshaft in the crankcase; and an air intake plenum that is integrally formed with the crankcase cover. The air intake plenum conveys intake air for combustion in the outboard marine engine.

BRIEF DESCRIPTION OF THE DRAWINGS

The present disclosure is described with reference to the following Figures. The same numbers are used throughout the figures to reference like features and like components.

DETAILED DESCRIPTION OF THE DRAWINGS

Figure 1:
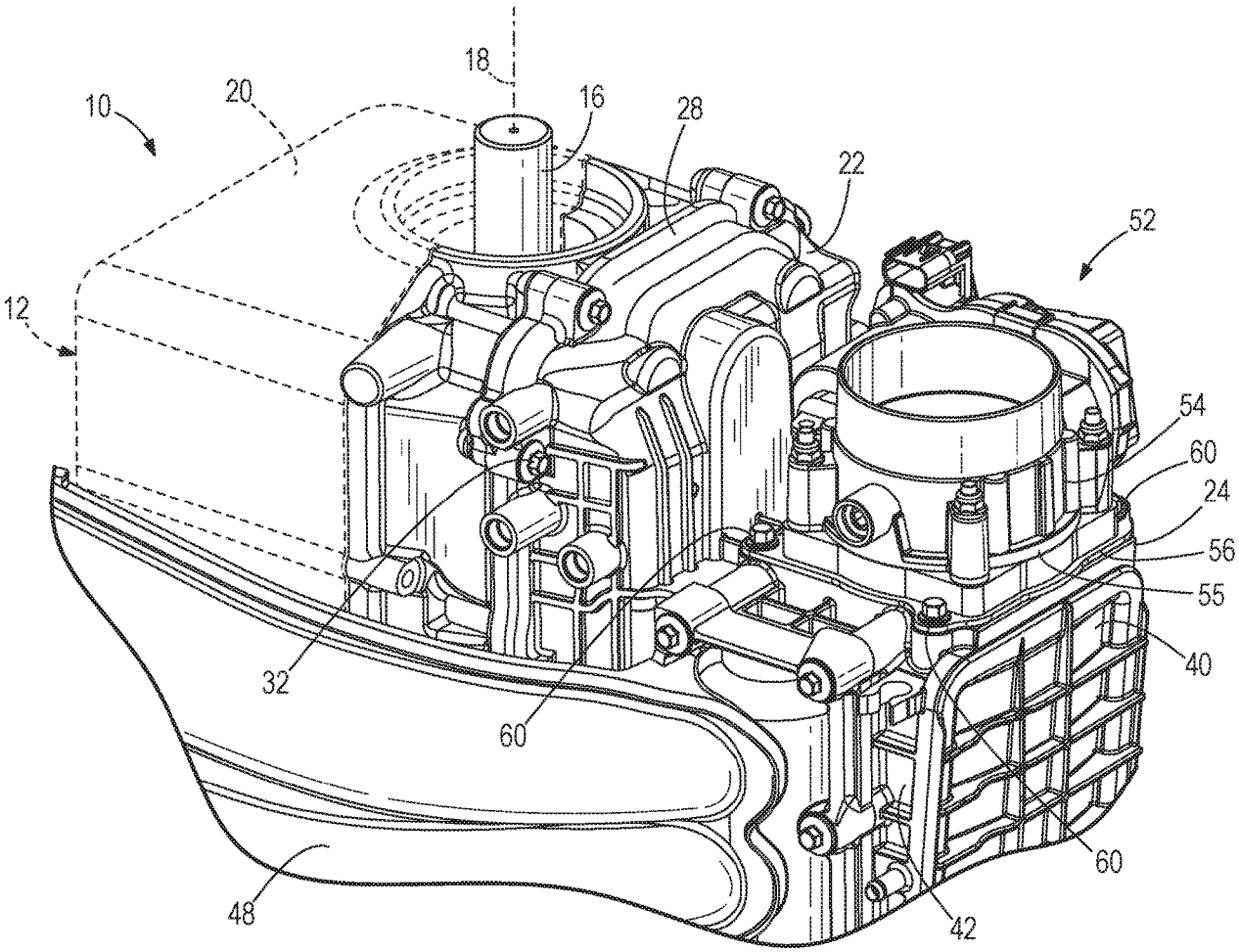
FIG. 1 is a perspective view of an upper portion of an outboard marine engine according to the present disclosure.
Figure 2:
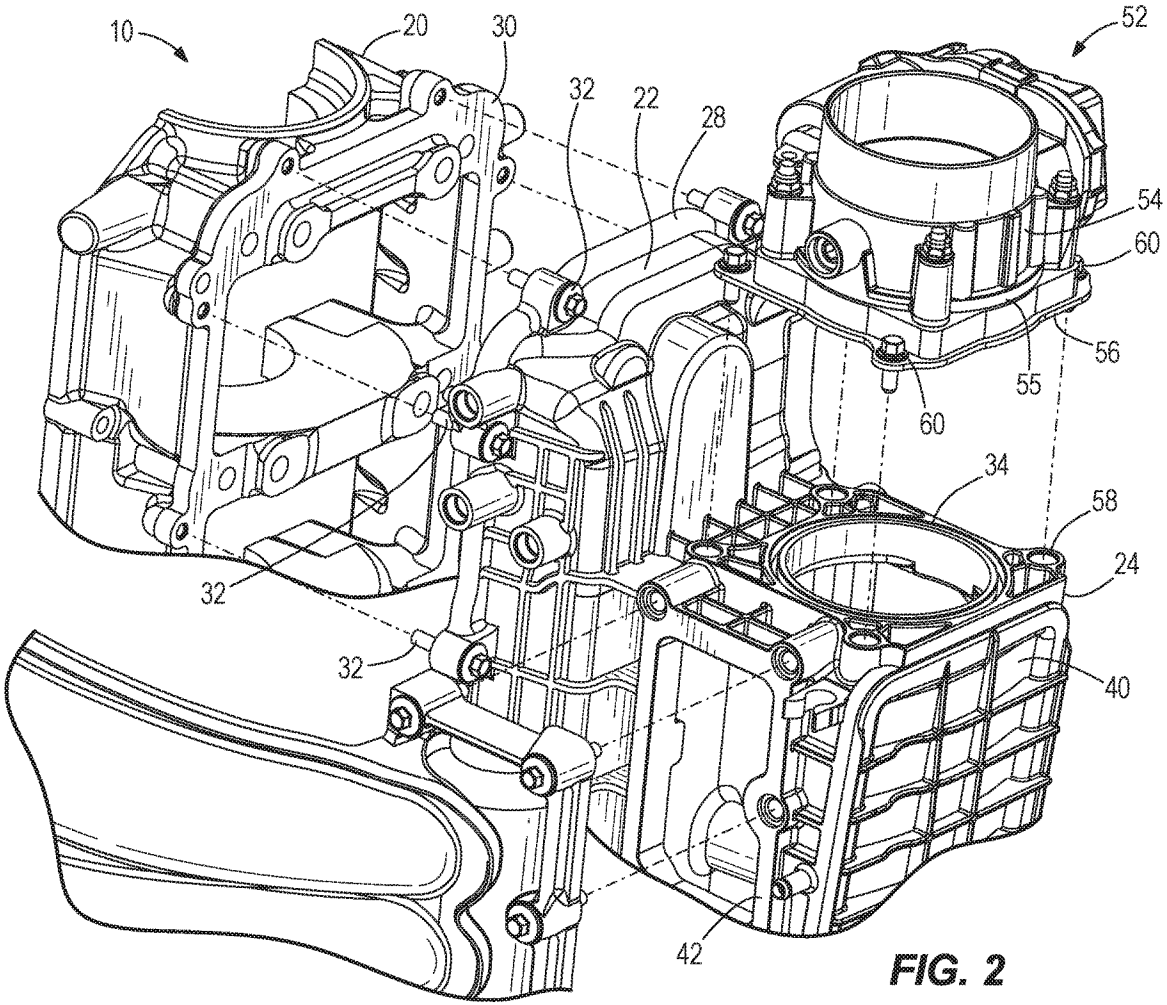
FIG. 2 is an exploded view of what is shown in FIG. 1
Figure 3:
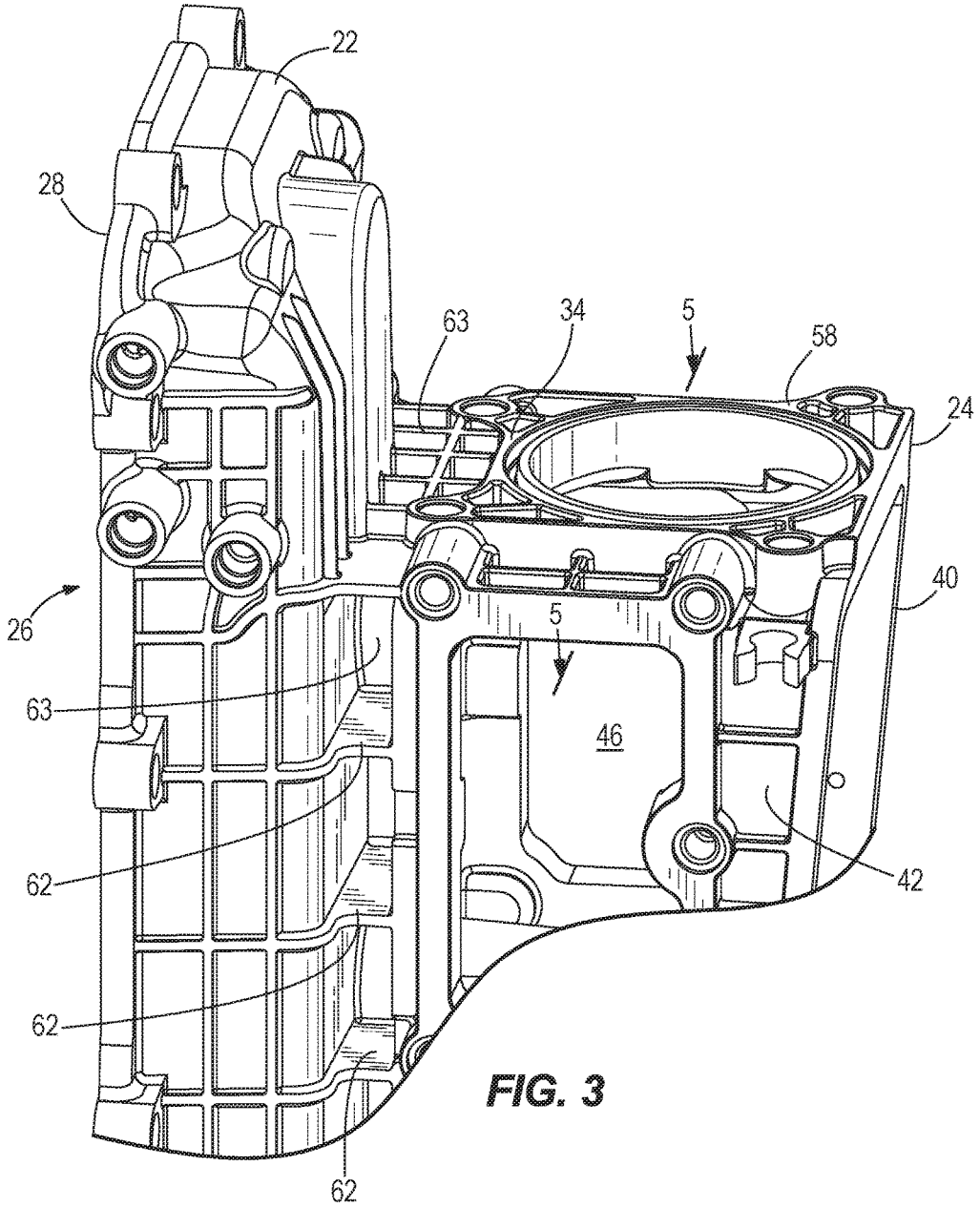
FIG. 3 is a side perspective view of an integrated intake plenum and crankcase cover according to the present disclosure.
Figure 4:
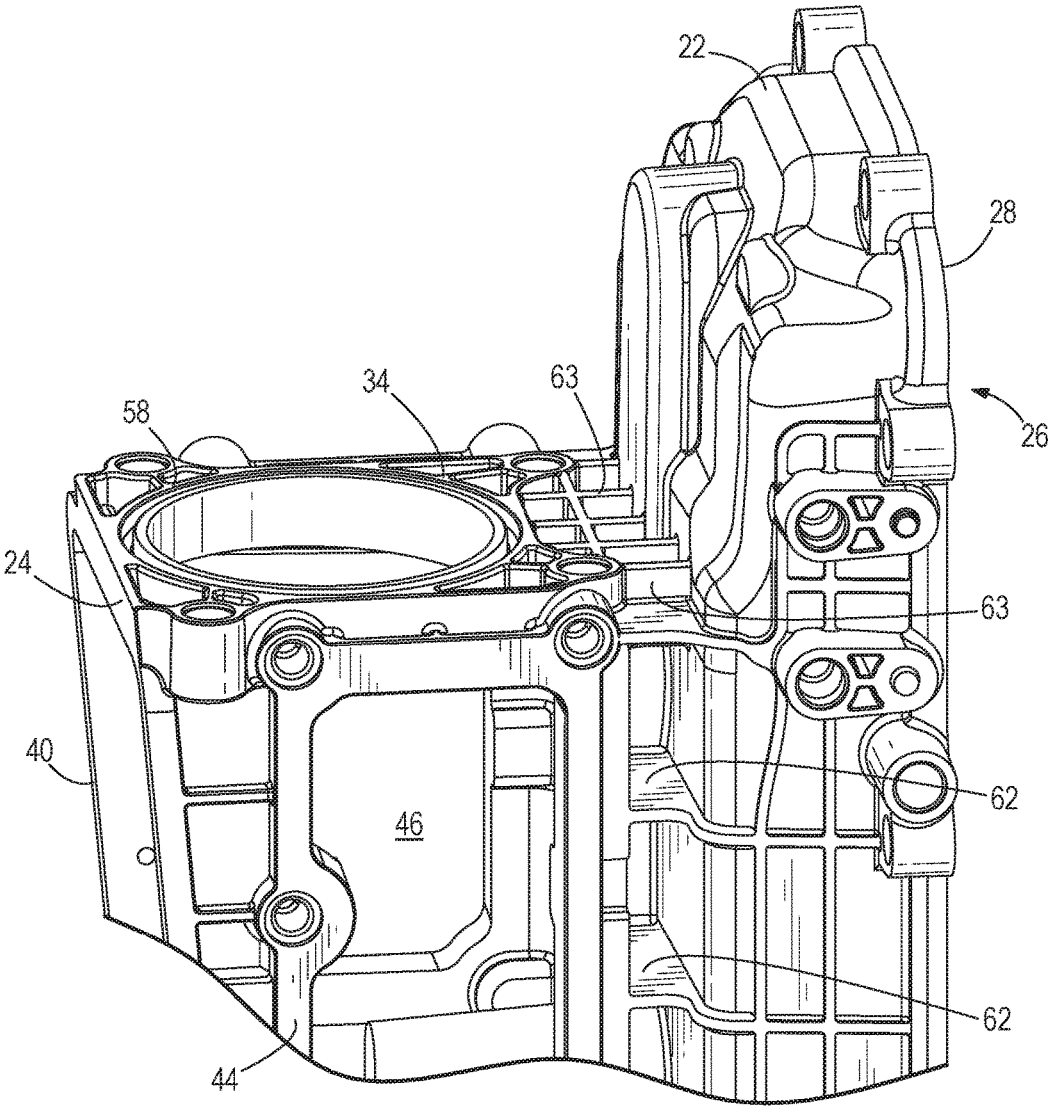
FIG. 4 is an opposite side perspective view of the integrated intake plenum and crankcase cover.
Figure 5:
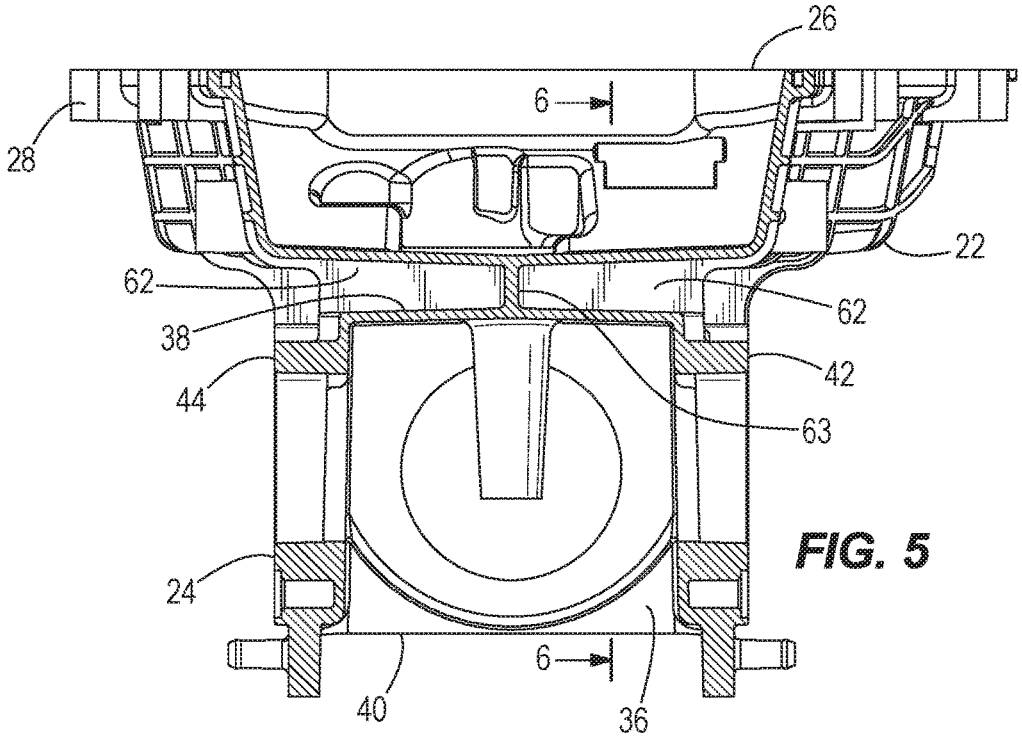
FIG. 5 is a view of Section 5-5, taken in FIG. 3.
Figure 6:
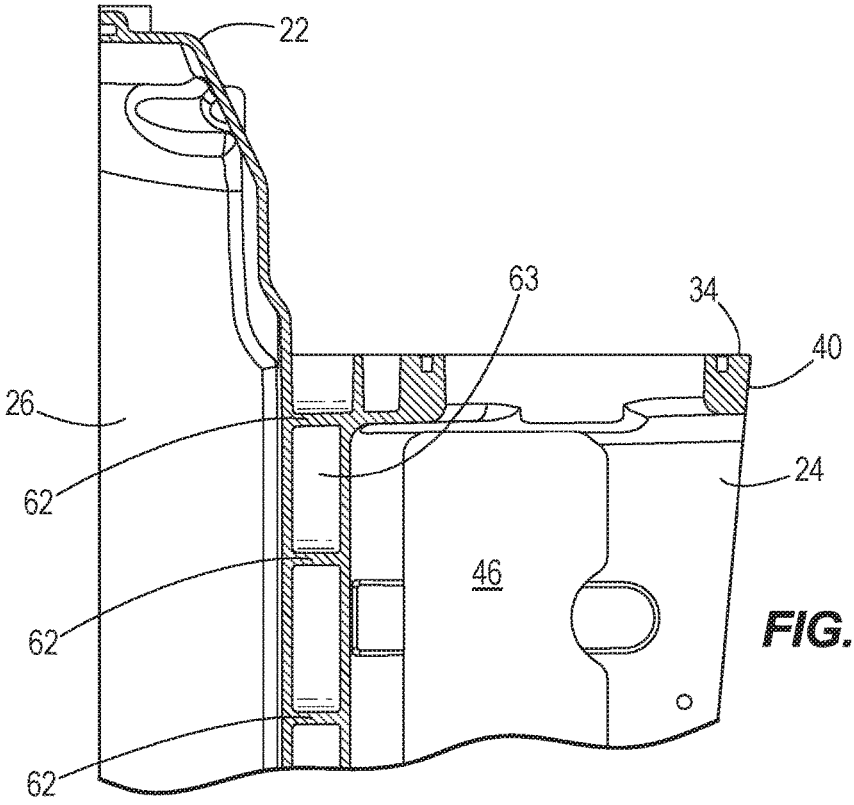
FIG. 6 is a view of Section 6-6, taken in FIG. 5.

FIGS. 1 and 2 depict an example of an outboard marine engine 10 according to the present disclosure. The outboard marine engine 10 includes an engine block 12. Although not shown, the engine block 12 can include first and second rows of vertically aligned piston-cylinders that are mounted transversely to each other in a conventional V-style configuration. Only one side of an intake configuration of the V-style is shown in solid line format in FIG. 1. One example of a suitable V-style configuration is disclosed in the above incorporated U.S. patent application Ser. No. 14/195,115. The outboard marine engine 10 can be a four-cylinder arrangement; however the concepts of the present disclosure are equally applicable to single cylinder engine arrangements, and/or engine arrangements having more cylinders, such as two-, four-, six- or eight-cylinder arrangements, and/or the like. The concepts of the present disclosure are equally applicable to inline engines and/or the like. As is conventional, combustion within the noted piston-cylinders induces reciprocal movement of connecting rods (not shown), which causes rotation of a crankshaft 16 about its crankshaft axis 18. The crankshaft 18 is disposed in a crankcase 20 on the engine block 12.

A crankcase cover 22 according to the present disclosure is disposed on the crankcase 20 so as to enclose the crankshaft 16 in the crankcase 20. An air intake plenum 24 is integrally formed with (e.g., cast together with or injected molded together with) the crankcase cover 22 and configured to convey intake air for combustion in the outboard marine engine 10. The crankcase cover 22 and air intake plenum 24 together form a monolithic component, as best shown in FIGS. 3-6. The crankcase cover 22 has an interior surface 26 that encloses the crankshaft 16 in the crankcase 20. The crankcase cover 22 also has a peripheral mounting flange 28 that is fastened to a corresponding peripheral mounting surface 30 (see FIG. 2) on the crankcase 20 by a plurality of fasteners 32.

The air intake plenum 24 has a top wall 34, a bottom wall 36 disposed opposite the top wall 34 with respect to the crankshaft axis 18, a front wall 38 that faces the crankcase cover 22, a rear wall 40 that faces away from the crankcase cover 22, and opposing side walls 42, 44, which together with the top wall 34, bottom wall 36, front wall 38 and rear wall 40 define an open interior 46 of the air intake plenum 24. As shown in FIGS. 1 and 2, respective pluralities of intake runners 48 (only one side is shown) laterally convey the intake air from opposite sides of the air intake plenum 24, for combustion in the outboard marine engine 10. The side walls 42, 44 have openings therein for laterally conveying the noted intake air to the pluralities of intake runners 48. A conventional throttle mechanism 52 is provided for throttling intake air to the intake air plenum 24. The throttle mechanism 52 includes a throttle body 54 that is coupled to the air intake plenum 24. More specifically, the throttle body 54 includes a downwardly facing mounting surface 55 that is coupled to an upwardly facing mounting surface 58 on the air intake plenum 24 by a plurality of fasteners 60. Optionally a resilient member that forms an isolator 56 can be sandwiched between the downwardly facing mounting surface and the mounting surface 58. The top wall 34 of the air intake plenum 24 has an opening therein for receiving downward flow of intake air from the throttle mechanism 52. As mentioned, the air intake plenum 24 is configured to laterally convey the intake air to the opposing pluralities of intake runners 48. It should be noted that although the throttle body 54 is mounted on top of the air intake plenum 24, in other arrangements, the throttle body 54 could be mounted to the front side or lower side of the air intake plenum 24. The illustrated example is not intended to be limiting.

Referring to FIGS. 3-6, the crankcase cover 22 and air intake plenum 24 together form a monolithic component that is devoid of connectors for connecting the crankcase cover 22 and air intake plenum 24 together. A plurality of transversely extending ribs 62 and a plurality of longitudinally extending ribs 63 are both integrally formed (e.g., cast or injection molded) with the crankcase cover 22 and air intake plenum 24 and thus integrally join the two components together. The plurality of transversely extending ribs 62 extend transversely to the crankshaft axis 18 between the crankcase cover 22 and air intake plenum 24. The plurality of longitudinally extending ribs 63 extend parallel to the crankshaft axis 18 and are between the crankcase cover 22 and the air intake plenum 24. The pluralities of ribs 62, 63 together define a plurality of air gaps between the crankcase cover 22 and air intake plenum 24. The air gaps are advantageously sized and shaped so as to provide a thermal separation between the crankcase cover 22 and air intake plenum 24.

In some examples, the crankcase cover 22 and air intake plenum 24 are made of plastic, for example injection molded plastic. In some examples, the crankcase cover 22 and air intake plenum 24 are made of reinforced Nylon PA-6 or PA-66 with 35% glass. In some examples, the air intake plenum 24 is made of two pieces of injection molded plastic that are vibration welded together, so as to form the noted monolithic component that is devoid of connectors for connecting the crankcase cover 22 and air intake plenum 24 together.

It will thus be seen that the present disclosure provides an integrated (monolithic) crankcase cover and air intake plenum for closing a crankcase volume and supplying plenum, intake air. The unique arrangement can have a rib structure that limits heat transfer from the crankcase oil wetted surfaces through the air intake plenum wall, all in a lightweight package. Crankcase mass savings is advantageously accomplished by reducing the number of fasteners and utilizing lower density material, as compared to prior art. The present disclosure thus provides an improved arrangement that accommodates limited packaging space in the outboard marine engine and provides reduced weight, while providing sufficiently stiff mounting for support of the engine block-to-intake plenum structure.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. An outboard marine engine comprising:

a crankcase;

a crankshaft disposed in the crankcase and being rotatable about a crankshaft axis;

a crankcase cover on the crankcase, the crankcase cover enclosing the crankshaft in the crankcase; and an air intake plenum that is integrally formed with the crankcase cover, wherein the air intake plenum conveys intake air for combustion in the outboard marine engine; and a plurality of ribs that are integrally formed with and join the crankcase cover and the air intake plenum;

wherein the crankcase cover and air intake plenum are a monolithic component having an interior surface that encloses the crankshaft in the crankcase, and wherein the crankcase cover, plurality of ribs, and air intake plenum are made of plastic.

2. The outboard marine engine according to claim 1, wherein the crankcase cover comprises a peripheral mounting flange and further comprising a plurality of fasteners that connect the peripheral mounting flange to a corresponding peripheral mounting surface on the crankcase.

3. The outboard marine engine according to claim 1, wherein the air intake plenum comprises a top wall, a bottom wall disposed opposite the top wall with respect to the crankshaft axis, a front wall that faces the crankcase cover, a rear wall that faces away from the crankcase cover and opposing sidewalls, which together with the top wall, bottom wall, front wall and rear wall define an interior of the air intake plenum.

4. The outboard marine engine according to claim 3, further comprising a plurality of intake runners, wherein the sidewalls define openings for conveying the intake air to the plurality of intake runners, which convey the intake air for combustion in the outboard marine engine.

5. The outboard marine engine according to claim 4, further comprising a throttle mechanism coupled to the air intake plenum, wherein the air intake plenum defines an opening for receiving intake air from the throttle mechanism.

6. The outboard marine engine according to claim 1, wherein the crankcase cover and air intake plenum form a monolithic component that is devoid of connectors for connecting the crankcase cover and air intake plenum together.

7. The outboard marine engine according to claim 1, wherein the plurality of ribs extends transversely to the crankshaft axis.

8. The outboard marine engine according to claim 7, wherein the plurality of ribs define a plurality of gaps between the crankcase cover and air intake plenum, the plurality of gaps providing thermal separation between the crankcase cover and the air intake plenum.

9. The outboard marine engine according to claim 1, wherein the plastic is injection molded.

10. The outboard marine engine according to claim 1, wherein a portion of the air intake plenum is made of two pieces of injection molded plastic that are vibration welded together to thereby form a monolithic component that is devoid of connectors for connecting the air intake plenum and crankcase cover together.

11. An air intake and crankcase apparatus for outboard marine engine having a crankcase and a crankshaft disposed in the crankcase for rotation about a crankshaft axis, wherein the air intake and crankcase apparatus comprises an integrated, monolithic crankcase cover for enclosing a crankcase volume and an air intake plenum for conveying air for combustion in the outboard marine engine; and a plurality of ribs that are integrally formed with the crankcase cover and the air intake plenum and define a plurality of gaps between the crankcase cover and air intake plenum, the plurality of gaps providing thermal separation between the crankcase cover and the air intake plenum; wherein the crankcase cover, plurality of ribs, and air intake plenum are made of plastic.

12. The outboard marine engine according to claim 11, wherein the crankcase cover comprises an interior surface for defining an extent of the crankcase and an exterior surface that is integrally formed with the air intake plenum.

13. The outboard marine engine according to claim 12, wherein the crankcase cover comprises a peripheral mounting flange and further comprising a plurality of fasteners that connect the peripheral mounting flange to the crankcase.

14. The outboard marine engine according to claim 12, wherein the air intake plenum comprises a top wall, a bottom wall disposed opposite the top wall with respect to the crankshaft axis, a front wall that faces the crankcase cover, a rear wall that faces away from the crankcase cover and opposing sidewalls that together with the top wall, bottom wall, front wall and rear wall define an interior of the air intake plenum.

15. The outboard marine engine according to claim 14, wherein the sidewalls define openings for conveying intake air to the engine block and the air intake plenum defines an opening for receiving intake air from a throttle mechanism.

16. The outboard marine engine according to claim 12, wherein the crankcase cover and air intake plenum form a monolithic component that is devoid of connectors connecting the crankcase cover and air intake plenum together.

* * * * *